US009771915B2

(12) United States Patent
Hirabayashi

(10) Patent No.: US 9,771,915 B2
(45) Date of Patent: Sep. 26, 2017

(54) ENGINE STARTING APPARATUS WITH INRUSH CURRENT REDUCER

(71) Applicant: DENSO CORPORATION, Kariya, Aichi-pref. (JP)

(72) Inventor: Takashi Hirabayashi, Chita-gun (JP)

(73) Assignee: DENSO CORPORATION, Kariya (JP)

( * ) Notice: Subject to any disclaimer, the term of this patent is extended or adjusted under 35 U.S.C. 154(b) by 60 days.

(21) Appl. No.: 14/726,891

(22) Filed: Jun. 1, 2015

(65) Prior Publication Data

US 2015/0354523 A1 Dec. 10, 2015

(30) Foreign Application Priority Data

Jun. 4, 2014 (JP) ..... 2014-115602

(51) Int. Cl.
*F02N 11/08* (2006.01)
*F02N 15/04* (2006.01)
(Continued)

(52) U.S. Cl.
CPC ..... *F02N 11/087* (2013.01); *F02N 15/046* (2013.01); *F02N 11/0851* (2013.01); *F02N 15/023* (2013.01); *F02N 15/067* (2013.01); *F02N 2015/061* (2013.01); *F02N 2200/023* (2013.01); *F02N 2200/044* (2013.01);
(Continued)

(58) Field of Classification Search
CPC .. F02N 15/046; F02N 11/0851; F02N 15/023; F02N 2015/061; F02N 2200/023; F02N 2200/044; F02N 2300/102; F02N 2300/104; F02N 2300/2011; F02N 11/087; F02N 2200/022; F02N 11/0855;
(Continued)

(56) References Cited

U.S. PATENT DOCUMENTS 6,782,860 B2 * 8/2004 Makajima ..... F02B 61/02 123/179.3
6,938,599 B2 * 9/2005 Senda ..... F02N 11/087 123/179.3
(Continued)

FOREIGN PATENT DOCUMENTS

JP 2004-197719 A 7/2004
JP 2009-224315 A 10/2009

*Primary Examiner* — Sizo Vilakazi
*Assistant Examiner* — Kevin R Steckbauer
(74) *Attorney, Agent, or Firm* — Oliff PLC

(57) ABSTRACT

An engine starting apparatus is provided which is equipped with a starter, an inrush current reducer, and a starter mode switch. The inrush current reducer works to reduce an inrush current flowing through an electric motor installed in the starter when the electric motor is energized. The starter mode switch works to change a starter characteristic that is an output characteristic of the starter continuously or selectively at least between a low-torque/high-speed mode and a high-torque/low-speed mode. The starter mode switch places the starter in the high-torque/low-speed mode at least at a time when a piston of the engine is passing a top dead center, and the engine friction has been just maximized for the first time after the starter is actuated to crank the engine. This shortens a period of time required to start up the engine without sacrificing beneficial effects offered by the inrush current reducer.

8 Claims, 3 Drawing Sheets

(51) Int. Cl.
*F02N 15/02* (2006.01)
*F02N 15/06* (2006.01)

(52) U.S. Cl.
CPC .. *F02N 2300/102* (2013.01); *F02N 2300/104* (2013.01); *F02N 2300/2011* (2013.01)

(58) Field of Classification Search
CPC .... F02N 15/067; F02N 11/08; F02N 11/0814; F02N 11/0848; F02N 11/00; F02N 11/0844
USPC ..... 123/179.3
See application file for complete search history.

(56) References Cited

U.S. PATENT DOCUMENTS 7,085,646 B2 * 8/2006 Tanaka ..... F02N 11/0803 123/179.3
7,216,617 B2 * 5/2007 Tanaka ..... F02D 41/266 123/179.3
7,804,180 B2 * 9/2010 Labbe ..... F02N 11/0859 290/34
7,915,984 B2 * 3/2011 Niimi ..... H01H 51/065 335/126
8,347,862 B2 * 1/2013 Pursifull ..... F02D 41/0027 123/478
8,487,573 B2 * 7/2013 Nakamura ..... F02N 11/087 290/38 R
8,590,500 B2 * 11/2013 Notani ..... F02N 11/0844 123/179.25
8,733,190 B2 * 5/2014 Palfai ..... F02N 11/0844 123/179.3
9,077,271 B2 * 7/2015 Labbe ..... F02N 11/08
9,083,269 B2 * 7/2015 Eschenhagen ..... F02N 11/087
9,121,380 B2 * 9/2015 Fulton ..... F02N 11/02
9,422,910 B2 * 8/2016 Gronwald ..... F02N 11/087
9,624,892 B2 * 4/2017 Hirabayashi ..... F02N 11/0814
2002/0124825 A1 * 9/2002 Ackermann ..... F02N 11/04 123/179.3
2003/0140881 A1 * 7/2003 Makajima ..... F02B 61/02 123/179.3
2004/0093967 A1 * 5/2004 Shiga ..... F02N 11/06 74/7 E
2004/0123587 A1 * 7/2004 Kamiya ..... F02D 41/0235 60/284
2004/0168664 A1 * 9/2004 Senda ..... F02N 11/087 123/179.3
2009/0206965 A1 * 8/2009 Niimi ..... H01H 50/54 335/106
2010/0282200 A1 * 11/2010 Notani ..... F02N 11/0844 123/179.3
2011/0118962 A1 * 5/2011 Couetoux ..... F02N 11/0844 701/113
2012/0119516 A1 * 5/2012 Connelly ..... F02N 11/0814 290/38 E
2013/0300130 A1 * 11/2013 Bradfield ..... H02K 23/10 290/38 R
2014/0260794 A1 * 9/2014 Neet ..... F02N 11/0851 74/7 A
2014/0311434 A1 * 10/2014 Hirabayashi ..... F02N 11/087 123/179.25
2014/0311436 A1 * 10/2014 Hirabayashi ..... F02N 11/00 123/179.25
2015/0285203 A1 * 10/2015 Hirabayashi ..... F02N 11/0848 123/179.25
2015/0308397 A1 * 10/2015 Hirabayashi ..... H02P 7/06 290/38 C
2015/0354524 A1 * 12/2015 Hirabayashi ..... F02N 11/0851 123/179.22
2017/0089426 A1 * 3/2017 O'Brien ..... F16H 3/003

* cited by examiner

ENGINE STARTING APPARATUS WITH INRUSH CURRENT REDUCER

CROSS REFERENCE TO RELATED DOCUMENT

The present application claims the benefit of priority of Japanese Patent Application No. 2014-115602 filed on Jun. 4, 2014, the disclosure of which is incorporated herein by reference.

BACKGROUND OF THE INVENTION

1 Technical Field

This disclosure relates generally to an engine starting apparatus which is equipped with an inrush current reducer to reduce an inrush current drawn by an electric motor when energized.

2 Background Art

Usually, too large an inrush current flowing through an electric motor of an engine starter when starting an engine will result in a great drop in terminal voltage at a storage battery, which may cause electronic control units (ECUs) installed in a vehicle to be reset or operations of solenoid actuators to be unstable. In order to reduce the inrush current flowing through the electric motor, Japanese Patent First Publication No. 2009-224315 teaches installing an ICR (Inrush Current Reduction) relay with a built-in resistor in a power supply line leading to the electric motor.

Engine starters for use in idle-stop systems (also called automatic engine stop/restart systems) of automotive vehicles are required to minimize a period of time it takes to restart the engine (which will also be referred to as an engine restart time below) in order to ensure the comfort of a driver or passengers. The shortening of the engine restart time may be achieved by increasing the speed at which the engine is cranked. In order to achieve this along with the ensuring of startability of the engine at low temperatures where the mechanical friction of the engine is usually high, it is necessary to use a large-sized and high-power electric motor in the engine starter.

The increasing of speed at which the engine is cranked without use of the large-sized and high-power electric motor may be accomplished by switching operating characteristics of an electric motor installed in the engine starter between a high-speed mode and a high-torque mode. For instance, Japanese Patent First Publication No. 2004-197719 discloses techniques for using an electric motor equipped with a field coil made up of a series winding and a shunt winding and controlling a field current flowing through the shunt winding through an ECU to switch between the high-speed mode and the high-torque mode.

However, when the engine starter is placed in the high-speed mode to start the engine, the torque, as outputted by the engine starter, is usually low, thus resulting in a great increase in current flowing through the electric motor when the piston of the engine passes the top dead center for the first time. This current, as illustrated in FIG. 3, may exceed the value of inrush current, as decreased by the ICR relay, thus encountering the drawback in that the level of the inrush current is not kept below a permissible level.

SUMMARY

It is therefore an object to provide an improved structure of an engine starting apparatus designed to decrease a period of time it takes to start an engine and keep the level of inrush current flowing through an electric motor below a desired level.

According to one aspect of the disclosure, there is provided an engine starting apparatus for an engine which comprises: (a) a starter which works to start an engine using torque, as produced by an electric motor; (b) an inrush current reducer which works to reduce an inrush current flowing through the electric motor when energized; and (c) a starter mode switch which works to change a starter characteristic that is an output characteristic of the starter continuously or selectively at least between a low-torque/high-speed mode and a high-torque/low-speed mode. The starter mode switch places the starter in the high-torque/low-speed mode at least at a time when a piston of an engine is passing a top dead center, and engine friction has just been maximized for the first time after the starter is actuated to crank the engine.

The expression "when a piston of an engine is passing a top dead center for the first time" means a transitional period of time during a compression stroke of the piston in the engine in which the piston passes the top dead center". The expression "when the engine friction has been just maximized" means the moment when the piston has reached the top dead center during the compression stroke of the engine.

The problem that too great an inrush current flowing through the electric motor the starter when the engine is started will result in a drop in voltage at a battery may be alleviated by using the inrush current reducer. However, when a low-torque/high-speed type starter is used to shorten a period of time required to start up the engine, too low a degree of torque may cause a value of current flowing through the electric motor of the starter to be higher when the piston passes the top dead center than a value of the inrush current decreased by the inrush current reducer. The maximum effects expected to be offered by the inrush current reducer will not, therefore, be obtained, which results in a risk that some defects arise from a drop in voltage at the battery such as the resetting of ECUs or instability in operation of solenoids installed in the vehicle.

In order to alleviate the above problem, the engine starting apparatus works to place the starter in the high-torque/low-speed mode, that is, to rotate the starter at a low speed to produce a high degree of torque at least at the time when the piston of the engine is passing the top dead center, and the engine friction has been just maximized for the first time after the starter is actuated. This results in a decrease in value of current flowing through the electric motor of the starter at the moment when the engine friction is maximized.

The decrease in value of the current flowing through the electric motor when the piston passes the top dead center during the compression stroke, in other words, when the engine friction is maximized results in a decrease in electric power consumed in starting the engine and improved fuel economy in the vehicle.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings.

DESCRIPTION OF THE PREFERRED EMBODIMENTS

Figure 1:
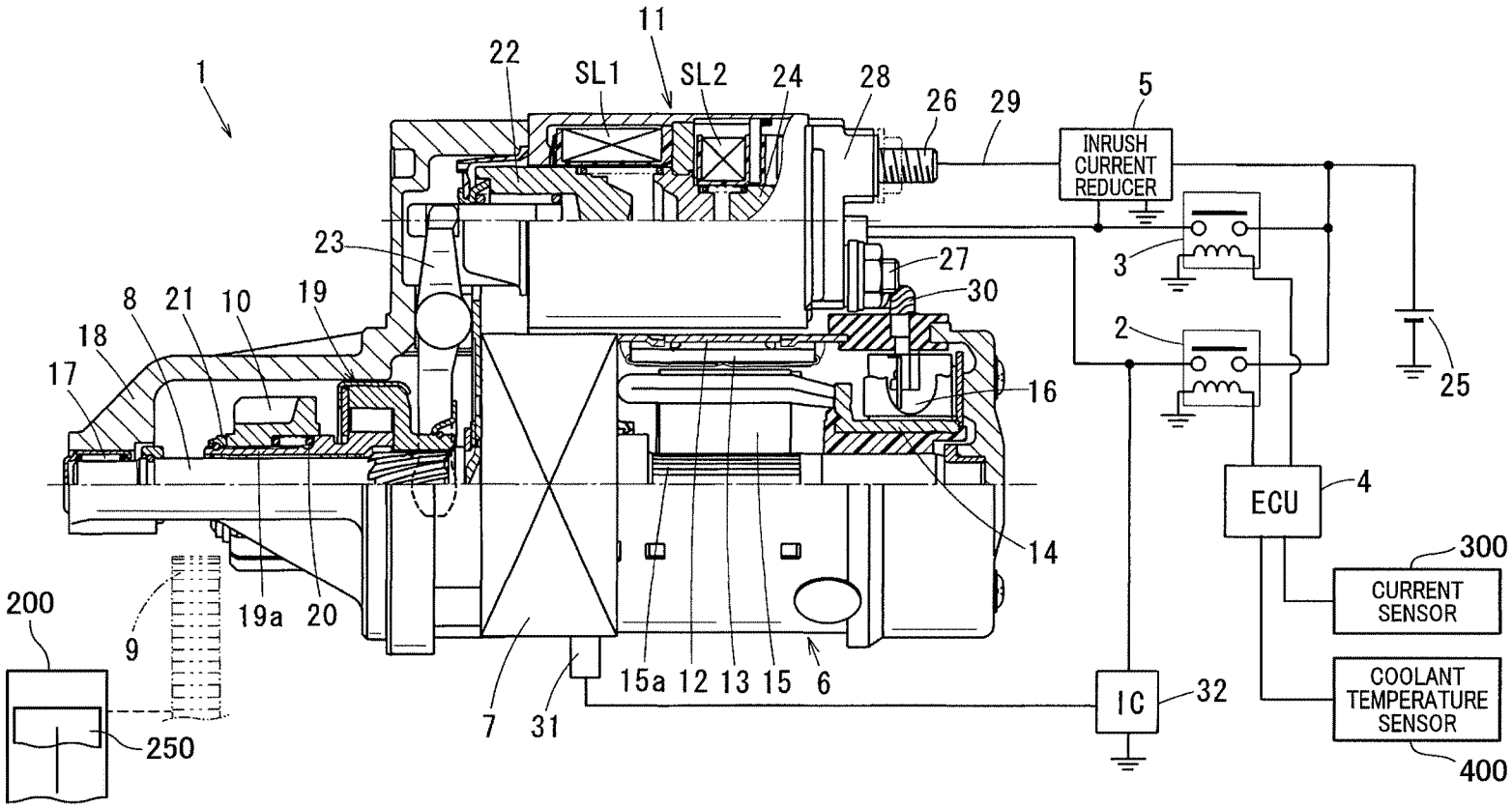
FIG. 1 is a partially longitudinal sectional view which illustrates an engine starting apparatus according to the first embodiment.

Referring to the drawings, wherein like reference numbers refer to like parts in several views, particularly to FIG. 1, there is shown an engine starting apparatus according to an embodiment. The engine starting apparatus includes an engine starter 1, a controller 4, an inrush current reducer 5, and a starter characteristic selector (which will also be described below in detail). The controller 4 is implemented by an electronic control unit (ECU) and works to control an operation of the engine starter 1 through starter relays 2 and 3. The inrush current reducer 5 is installed in a starting circuit of the starter 1. The starter characteristic selector is engineered to change output characteristics of the starter 1 (which will also be referred to as starter characteristics below) continuously or at least between two modes.

The starter 1 is made up of an electric motor 6, an output shaft 8, a pinion 10, and an electromagnetic solenoid device 11 which will be described later in detail. The electric motor 6 works to produce torque when energized. The torque is transmitted to the output shaft 8 through a variable speed reducer 7, which will be described later in detail. The pinion 10 outputs the torque, as produced by the motor 6, to a ring gear 9 coupled to an engine 200 such as an internal combustion engine.

The motor 6 is implemented by a brushed DC motor which includes a field system, an armature 15, and brushes 16. The field system is made up of a yoke 12 and permanent magnets 13 arranged on an inner periphery of the yoke 12. The armature 15 has a commutator 14 disposed on an axis thereof. The brushes 16 ride on the outer periphery of the commutator 14 to be slidable along with rotation of the armature 15. The field system may alternatively be made of a field winding instead of the permanent magnets 13.

The output shaft 8 is disposed coaxially with an armature shaft 15*a* of the motor 6 through the variable speed reducer 7. The output shaft 8 has an end farther away from the motor 6 and is retained at that end by a starter housing 18 through a bearing 17.

The pinion 10 directly engages an outer periphery of an inner tube 19*a* through splines. The inner tube 19*a* is a part of a clutch 19. The pinion 10 is urged by a pinion spring 20 toward a top of the inner tube 19*a* (i.e., a leftward direction, as viewed in FIG. 1) into contact with a pinion stopper 21.

The clutch 19 engages the outer periphery of the output shaft 8 through helical splines and works as a one-way clutch which transmits the torque, as produced by the motor 6, to the pinion 10 and blocks the transmission of torque from the pinion 10 to the output shaft 8 when the pinion 10 is being rotated by the engine 200.

The electromagnetic solenoid device 11 is equipped with a solenoid SL1 and a solenoid SL2. The solenoid SL1 works to move a plunger 22 to thrust the pinion 10 and the clutch 19 together through a shift lever 23. The solenoid SL2 works to move a plunger 24 to open or close main contacts (which will be described later in detail).

The main contacts include a pair of fixed contacts and a movable contact. The fixed contacts are connected through two terminal bolts 26 and 27 to a power supply path through which the electric power is supplied from a battery 25 to the motor 6. The movable contact is moved by the movement of the plunger 24 to electrically close or open the fixed contacts.

The terminal bolts 26 and 27 are secured to a resinous cover 28 which covers the rear end (i.e., the right end in FIG. 1) of the electromagnetic solenoid device 11. The terminal bolt 26 is connected to a positive terminal of the battery 25 through a battery cable 29. The ter urinal bolt 27 is connected to a positive brush 16 through a motor lead 30.

The inrush current reducer 5 is made up of a resistor and an electromagnetic relay. The resistor is disposed in the power supply path for the battery 6, that is, in the battery cable 29. The electromagnetic relay has relay contacts which are disposed in the battery cable 29 in parallel to the resistor. The electromagnetic relay works to energize or deenergize an electromagnet installed therein to close or open the relay contacts. When the relay contacts are opened, the terminal bolt 26 connects with the battery 25 through the resistor. Alternatively, when the relay contacts are closed, the terminal bolt 26 bypasses the resistor and connects directly with the battery 25. The electromagnetic relay includes a relay coil which functions as the electromagnet when electrically energized. Specifically, when the starter relay 3 is turned on, power is supplied from the battery 25 to the relay coil. After a lapse of a given period of time following the turning on of the starter relay 3, the relay coil is deenergized. The period of time between the turning on of the starter relay 3 and the deenergization of the relay coil is set by, for example, a timer. The relay contacts are of a normally closed type. Specifically, when the relay coil is energized to create the electromagnet, the relay contacts are opened, so that the battery 25 connects with the terminal bolt 26 through the resistor. When the supply of power to the relay coil is cut, the magnetic attraction, as produced by the electromagnet, disappears, so that the relay contacts are closed.

The switching of the starter characteristics will be described below in detail.

The starter characteristic selector is equipped with the variable speed reducer 7 and a speed reducing operation switch 31 which works as a starter mode switch to change the operation of the variable speed reducer 7 (i.e., the starter 1) between a deceleration mode and a non-deceleration mode.

The variable speed reducer 7 is made of, for example, a known planetary gear speed reducer. The speed reducing operation switch 31 is engineered to switch between the deceleration mode in which an internal gear (not shown) of the planetary gear speed reducer is held from rotating and the non-deceleration mode in which the internal gear of the planetary gear speed reducer is permitted to rotate. The speed reducing operation switch 31 includes, for example, an electric powered actuator (not shown) to change the operation of the variable speed reducer 7 between the deceleration mode and the non-deceleration mode.

In the deceleration mode, the internal gear of the variable speed reducer 7 is, as described above, held by the electric powered actuator from rotating, so that the variable speed reducer 7 works as a typical speed reducer to reduce the speed of rotation of the motor 6 inputted thereto and transmit it to the output shaft 8.

In the non-deceleration mode, the holding of the internal gear from rotating is released to permit the internal gear to rotate. The variable speed reducer 7, therefore, does not work as the speed reducer. Specifically, when the motor 6 rotates, gears (i.e., the internal gear, planet gears, and a sun gear) of the variable speed reducer 7 rotate together, so that the speed of rotation of the motor 6 is not reduced, that is, it is transmitted directly to the output shaft 8 as it is.

As apparent from the above discussion, the output characteristics (i.e., the starter characteristics) of the starter 1 include a high-torque/low-speed characteristic, as established in the deceleration mode, and a low-torque/high-speed characteristic, as established in the non-deceleration mode.

The operation of the starter 1 will be described below.

An example where the engine 200 is restarted after the engine 200 is stopped in an idle-stop mode will be discussed.

When a restart request is made to restart the engine 200, the ECU 4 first turns on the starter relay 2 and then turns on the starter relay 3.

When the starter relay 2 is turned on to energize the solenoid SL1, the plunger 22 is moved to push the pinion 10 and the clutch 19 together through the shift lever 23 away from the motor 6 (i.e., the leftward direction in FIG. 1). When the teeth of the pinion 10 are out of a position engageble with teeth of the ring gear 9, it will cause the end surface of the teeth of the pinion 10 to impact that of the ring gear 9.

Afterwards, when the starter relay 3 is turned on by the ECU 4 to energize the solenoid SL2, it will cause the plunger 24 to be moved to bring the movable contact into abutment with the fixed contacts to close the main contacts. Additionally, when the starter relay 3 is turned on, the electromagnetic relay of the inrush current reducer 5 is opened, so that the electric power is supplied from the battery 25 to the motor 6 through the resistor, thereby reducing the inrush current flowing through the motor 6. The motor 6, thus, rotates at a low speed without being subjected to a rapid rise in speed. The torque, as produced by the motor 6, is transmitted to the output shaft 8 through the variable speed reducer 7 and then to the pinion 10 through the clutch 19, so that the pinion 10 rotates. When the pinion 10 rotates until a position engageble with the ring gear 9, it will cause the teeth of the pinion 10 to mesh with those of the ring gear 9.

After a lapse of a set period of time following the turning on of the starter relay 3, the electromagnetic relay of the inrush current reducer 5 is, as described above, closed. This causes a bypass path short-circuiting ends of the resistor of the inrush current reducer 5 in the power supply path to be created, so that the full voltage, as developed at the battery 25, is applied to the motor 6. The motor 6 then rotates at a high speed, so that the torque, as produced by the motor 6, is transmitted from the pinion 10 to the ring gear 9 to crank the engine 200.

Figure 2:
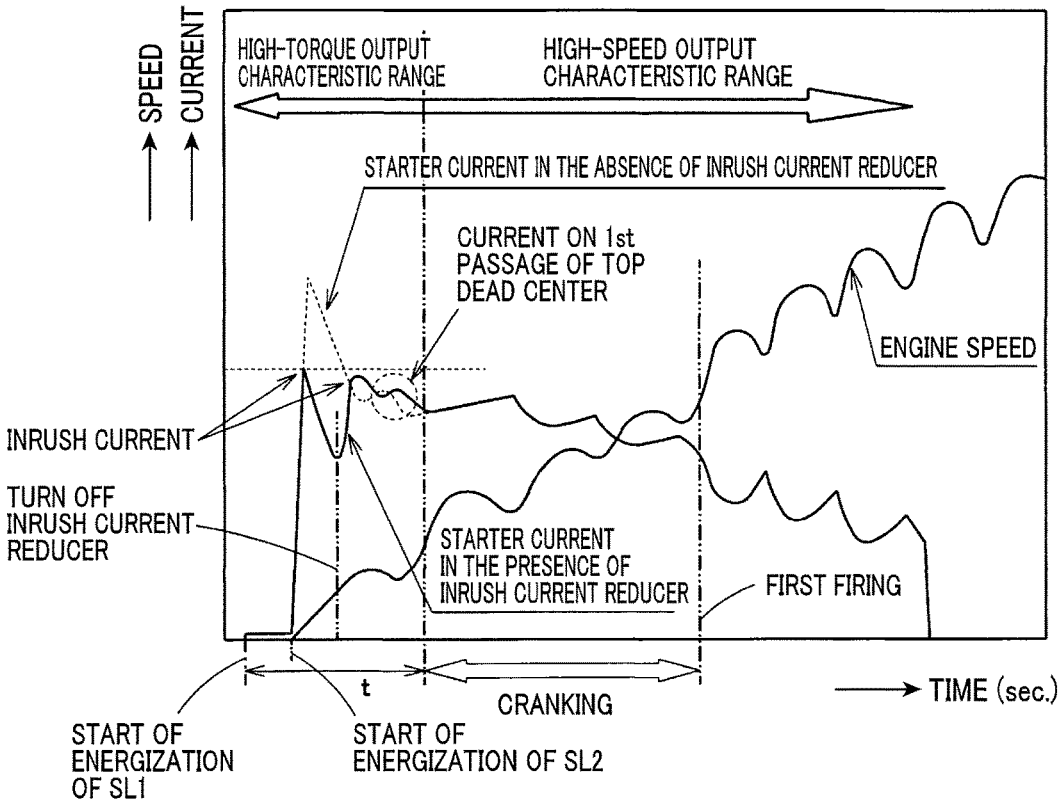
FIG. 2 is a waveform diagram which demonstrates variations in motor current and engine speed when an engine is started in the first embodiment.
Figure 3:
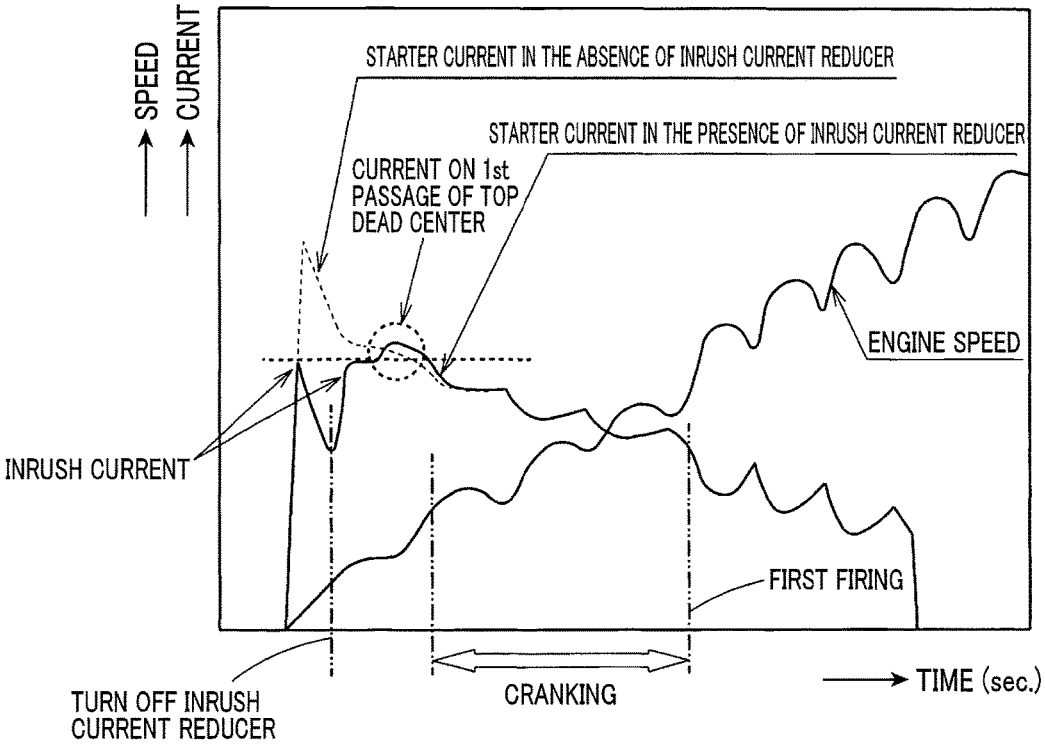
FIG. 3 is a waveform diagram which demonstrates variations in motor current and engine speed when an engine is started using a conventional low-torque/high-speed starter.

After the starter 1 starts to be actuated, the variable speed reducer 7 is placed in the deceleration mode at least until the piston 250 of the engine 200 passes the top dead center for the first time during the compression stroke of the piston 250. After the piston 250 of the engine 200 has passed the top dead center for the first time, the variable speed reducer 7 is switched to the non-deceleration mode. Specifically, the starter characteristics established by the variable speed reducer 7, as can be seen in FIG. 2, exhibit the high-torque/low-speed characteristic at least when the piston 250 of the engine 200 passes the top dead center during the compression stroke of the piston 250 for the first time after the starter 1 starts to be actuated and then exhibit the low-torque/high-speed characteristic when the engine 200 is being cranked after the piston 250 of the engine 200 passes the top dead center for the first time.

The time when the starter characteristics should be switched from the high-torque/low-speed characteristic to the low-torque/high-speed characteristic (which will also be referred to as a switching time below), that is, the operation of the starter 1 should be changed by the starter mode switch (i.e., a combination of the variable speed reducer 7 and the speed reducing operation switch 31) from a high-torque/low-speed mode (i.e., the deceleration mode) to a low-torque/high-speed mode (i.e., the non-deceleration mode) is set by, for example, a timer circuit 32, as illustrated in FIG. 1. Specifically, the time interval between the start of energization of the solenoid SL1 and when the piston 250 of the engine 200 has passed the top dead center for the first time after the starter 1 is actuated is measured in advance and then set in the timer circuit 32. The timer circuit 32 starts to count the time in response to an on-signal, as outputted from the ECU 4 to the starter relay 2, which starts to energize the solenoid SL1. When the time counted by the timer circuit 32 has passed a preselected time t, as illustrated in FIG. 2, the timer circuit 32 starts to turn on the electric powered actuator of the speed reducing operation switch 31 to switch the operation mode of the variable speed reducer 7 to the non-deceleration mode.

The switching time when the starter characteristics should be switched from the high-torque/low-speed characteristic to the low-torque/high-speed characteristic is, as described above, set in the timer circuit 32 as a fixed value, but however, may be changed continuously or intermittently as a function of a given parameter. For instance, the switching time may be changed continuously or intermittently as a function of an amount of charge in the battery 25 such as a state of charge (SOC) of the battery 25. Specifically, the switching time is decreased with an increase in amount of charge in the battery 25. This is because when the amount of charge in the battery 25 is great, it will cause the value of the inrush current to rise, but the voltage at the battery 25 is high enough to ensure the stability in operation of electric devices, as described above, such as ECUs or solenoids installed in the vehicle. For instance, when the amount of charge in the battery 25 is small, the switching time is set to 120 msec. while when the amount of charge in the battery 25 is great, the switching time is set to 90 msec. The amount of charge in the battery 25 may be measured by a current sensor 300 illustrated in FIG. 1. Alternatively, the switching time may be changed continuously or intermittently with an increase in temperature of coolant of the engine 200. This is for enhancing the response speed at which the starter 1 restarts the engine 200 after the engine 200 is warmed up. For instance, when the temperature of coolant is low, that is, the engine 200 is in a cold condition, the switching time is set to 250 msec. while when the engine 200 is in a warmed-up condition, the switching time is set to 150 msec. Alternatively, when the engine 200 is in the cold condition, the switching time may be set to a time when the piston 250 passes the top dead center two times. In other words, the operation mode of the variable speed reducer 7 is kept in the deceleration mode until the piston 250 passes the top dead center two times after the starter 1 starts to be actuated in order to reduce the consumed amount of electric power in the engine starting apparatus and ensure the stability in starting the engine 200 because the mechanical friction in the engine 200 (i.e., the engine friction) is high in cold conditions. The temperature of coolant for the engine 200 may be measured by a coolant temperature sensor 400 illustrated in FIG. 1.

The engine starting apparatus of the first embodiment offers the following advantages.

When the main contacts are closed by the solenoid SL2, the engine starting apparatus works to reduce the inrush current flowing in the motor 6 through the inrush current reducer 5. This avoids an undesirable drop in voltage at the battery 25, thereby avoiding the resetting of the ECUs installed in the vehicle or instability in operation of the solenoids.

At least at a time when the piston 250 of the engine 200 is passing the top dead center during the compression stroke of the piston 250 for the first time after the starter 1 starts to be actuated, and the engine friction has been just maximized, the starter characteristics are selected to exhibit the high-torque/low-speed characteristic, in other words, the starter 1 is placed in the high-torque/low-speed mode, thereby decreasing the value of current flowing through the motor 6 at the time when the piston 250 reaches the top dead center, that is, the engine friction is maximized. This causes, as demonstrated in FIG. 2, the value of current in the motor 6 when the piston 250 passes the top dead center for the first time to be smaller than the value of inrush current, as decreased by the inrush current reducer 5, thus enhancing the stability in operation of the engine starting apparatus and reducing the electric power consumed in starting the engine 200 to improve the fuel economy in the vehicle. The moment when the piston 250 passes the top dead center may be determined as a moment when the value of current flowing through the motor 6 is maximized. At least at such a time, the ECU 4 places the operation of the variable speed reducer 7 in the deceleration mode.

After the piston 250 of the engine 200 has passed the top dead center for the first time after the starter 1 is actuated, the starter characteristics are switched to exhibit the low-torque/high-speed characteristic, thereby increasing the speed at which the engine 200 is cranked to shorten the time required to start up the engine 200. Particularly, in the case where the vehicle is equipped with the idle-stop system, the engine starting apparatus serves to reduce a time interval between when the starter 1 is turned on (i.e., the start of energization of the solenoid SL1) and when the engine 200 is restarted, thereby giving the driver or passengers in the vehicle a smooth ride.

The use of the timer circuit 32 to switch the operation of the variable speed reducer 7 between the deceleration mode and the non-deceleration mode facilitates the ease with which the time when the starter characteristics should be switched from the high-torque/low-speed characteristic to the low-torque/high-speed characteristic is controlled and also enhances the accuracy in deter mining such a time.

The use of the brushed DC motor 6 in the starter 1 realizes the engine starting apparatus at a low cost as compared with when an AC motor is used which needs an inverter to control a large electric current.

The engine starting apparatus of the second embodiment will be described below. The same reference numbers as employed in the first embodiment will refer to the same parts, and explanation thereof in detail will be omitted here.

The starter 1 of this embodiment is equipped with a plurality of variable speed reducers 7 which are joined in series with each other and a plurality of speed reducing operation switches 31 provided one for each of the variable speed reducers 7. Each of the variable speed reducers 7, like in the first embodiment, works in a selected one of the deceleration mode and the non-deceleration mode. Each of the speed reducing operation switches 31 works to switch the operation of a corresponding one of the variable speed reducers 7 between the deceleration mode and the non-deceleration mode. The ECU 4 controls the operations of the speed reducing operation switches 31 respectively to switch the operation of the starter 1 (i.e., the starter characteristics) among at least three modes.

For instance, the ECU 4 operates the starter 1 in a highest-torque/lowest-speed mode at a time when the piston 250 of the engine 200 passes the top dead center for the first time after the starter 1 is actuated, in a middle-torque/middle-speed mode during a time interval until the piston 250 reaches the top dead center for the first time after the starter 1 starts to be actuated, and in a lowest-torque/highest-speed mode when the engine 200 is being cranked after the piston 250 has passed the top dead center. The highest-torque/lowest-speed mode is an operation mode of the starter 1 which outputs a highest possible degree of torque from the pinion 10 and rotates the pinion 10 at a lowest possible speed.

The high-torque/low-speed mode of the starter 1 is to reduce the speed at which the pinion 10 is rotated by the motor 6 and then meshes with the ring gear 9, thus ensuring the reliability in achieving the engagement between the pinion 10 and the ring gear 9. However, too high torque when the motor 6 starts to be actuated results in an increase in mechanical friction between the end surfaces of the pinion 10 and the ring gear 9 when the pinion 10 meshes with the ring gear 9, which leads to a decrease in durability of the starter 1. In order to alleviate this drawback, the engine starting apparatus of this embodiment may be designed to drive the starter 1 to output a middle degree of torque during a time interval until the piston 250 first reaches the top dead center after the start of the starter 1, in other words, a degree of torque suitable for achieving the engagement between the pinion 10 and the ring gear 9 in terms of the durability of the starter 1 and reliability in cranking the engine 200. The middle degree of torque is set to be lower than the degree of torque produced by the starter 1 when the piston 250 passes the top dead center in the engine 200. The above control of the starter 1 minimizes the mechanical friction between the end surfaces of the pinion 10 and the ring gear 9 when they mesh with each other to ensure the durability of the starter 1 and improves the stability in establishing the engagement between the pinion 10 and the ring gear 9 with the aid of a decreased speed of the pinion 9.

MODIFICATIONS

While the present invention has been disclosed in terms of the preferred embodiments in order to facilitate better understanding thereof, it should be appreciated that the invention can be embodied in various ways without departing from the principle of the invention.

Instead of use of the timer circuit 32 to switch the operation mode of the variable speed reducer 7, the ECU 4 may be designed to have a timer function to determine the time when the operation of the variable speed reducer 7 should be changed from the deceleration mode to the non-deceleration mode. The timer circuit 32 used in the first embodiment counts the time t that is an interval between the start of energization of the solenoid SL1 and when the starter characteristics should be changed. In other words, the timer circuit 32 starts operating in response to the on-signal to energize the starter relay 2, but however, it may be engineered to start operating in response to the on-signal outputted from the ECU 4 to the starter relay 3 to energize the solenoid SL2. In other words, when the timer circuit 32 has finished counting a given period of time since the start of energization of the solenoid SL2, the timer circuit 32 may turn on the electric powered actuator of the speed reducing operation switch 31.

The engine starting apparatus of the first embodiment works to switch the operation of the starter 1 (i.e., the variable speed reducer 7) from the deceleration mode (i.e., the high-torque/low-speed characteristic) to the non-deceleration mode (i.e., the low-torque/high-speed characteristic). The engine starting apparatus of the second embodiment works to switch the operation of the starter 1 among at least three modes between the high-torque/low-speed characteristic and the low-torque/high-speed characteristic. The engine starting apparatus, however, may be engineered to continuously change the operation (i.e., the starter characteristics) of the starter 1 in a non-stepwise fashion.

The starter 1 in the above embodiment works to move the pinion 10 toward the ring gear 9, but may alternatively be designed as a permanently engaged starter in which the pinion 10 is placed in constant engagement with the ring gear 9 or a belt-driven starter.

The electromagnetic solenoid device 1 used in the above embodiment is of a tandem solenoid type equipped with the solenoid SL1 to push the pinion 10 and the solenoid SL2 to close or open the main contacts, but however, may alternatively be engineered to perform these two operations using a single solenoid.

What is claimed is:

1. An engine starting apparatus for an engine comprising:

a starter which works to start an engine using torque, as produced by an electric motor;

an inrush current reducer which works to reduce an inrush current flowing through the electric motor when energized; and variable speed changing device transmitting torque from the electric motor to an output shaft thereof and configured to change the speed and torque of the output shaft continuously or selectively at least between a low-torque/high-speed mode and a high-torque/low-speed mode, the variable speed changing device placing the starter in the high-torque/low-speed mode at least at a time when a piston of an engine is passing a top dead center, and an engine friction has just been maximized for the first time after the starter is actuated to crank the engine, wherein the variable speed changing device is a separate device from the electric motor.

2. An engine starting apparatus as set forth in claim 1, further comprising a starter mode switch controlling the variable speed changing device to change a starter characteristic that is an output characteristic of the output shaft of the starter continuously or selectively at least between the low-torque/high-speed mode and the high-torque/low-speed mode, wherein the starter characteristic used when the piston of the engine passes the top dead center for the first time after the starter is actuated is determined so that a value of current flowing in the electric motor when the piston of the engine passes the top dead center for the first time is lower than a value of the inrush current flowing in the electric motor reduced by the inrush current reducer.

3. An engine starting apparatus as set forth in claim 1, further comprising a starter mode switch controlling the variable speed changing device to change a starter characteristic that is an output characteristic of the output shaft of the starter continuously or selectively at least between the low-torque/high-speed mode and the high-torque/low-speed mode, wherein the starter characteristic used when the piston of the engine passes the top dead center for the first time after the starter is actuated is provided to exhibit a highest-torque/lowest-speed characteristic of the starter.

4. An engine starting apparatus as set forth in claim 1, further comprising a starter mode switch controlling the variable speed changing device to change a starter characteristic that is an output characteristic of the output shaft of the starter continuously or selectively at least between the low-torque/high-speed mode and the high-torque/low-speed mode, wherein a switching time that is a time when the starter characteristic is switched from the high-torque/low-speed mode to the low-torque/high-speed mode is provided as being a time after the piston has passed the top dead center for the first time by determining a time interval between start of operation of the starter and the switching time using a timer function.

5. An engine starting apparatus as set forth in claim 1, wherein the electric motor is a brushed DC motor.

6. An engine starting apparatus as set forth in claim 1, further comprising a starter mode switch controlling the variable speed changing device to change a starter characteristic that is an output characteristic of the output shaft of the starter continuously or selectively at least between the low-torque/high-speed mode and the high-torque/low-speed mode, wherein a switching time that is a time when the starter characteristic is switched from the high-torque/low-speed mode to the low-torque/high-speed mode is set to a preselected fixed value.

7. An engine starting apparatus as set forth in claim 1, further comprising a starter mode switch controlling the variable speed changing device to change a starter characteristic that is an output characteristic of the output shaft of the starter continuously or selectively at least between the low-torque/high-speed mode and the high-torque/low-speed mode, wherein a switching time that is a time when the starter characteristic is switched from the high-torque/low-speed mode to the low-torque/high-speed mode is determined as a function of the amount of charge in an electric power source which supplies electric power to the electric motor of the starter.

8. An engine starting apparatus as set forth in claim 1, further comprising a starter mode switch controlling the variable speed changing device to change a starter characteristic that is an output characteristic of the output shaft of the starter continuously or selectively at least between the low-torque/high-speed mode and the high-torque/low-speed mode, wherein a switching time that is a time when the starter characteristic is switched from the high-torque/low-speed mode to the low-torque/high-speed mode is determined as a function of the temperature of coolant for the engine.

* * * * *